United States Patent [19]

Tufts

[11] 4,377,874

[45] Mar. 29, 1983

[54] BYPASS VALVE FOR A TOILET SYSTEM

[75] Inventor: Wesley M. Tufts, Holliston, Mass.

[73] Assignee: International Water Saving Systems, Inc., New York, N.Y.

[21] Appl. No.: 320,459

[22] Filed: Nov. 12, 1981

[51] Int. Cl.[3] ..... E03D 1/00; E03D 9/10

[52] U.S. Cl. ..... 4/323; 4/320; 4/321

[58] Field of Search ..... 4/319, 320, 321, 300, 4/317, 323

[56] References Cited

U.S. PATENT DOCUMENTS

| | | | |
|---|---|---|---|
| 1,732,775 | 10/1929 | Shaver | 4/319 X |
| 2,042,641 | 6/1936 | Victoria | 4/319 X |
| 3,228,036 | 1/1966 | Zaske et al. | 4/320 |
| 3,713,177 | 1/1973 | Tufts et al. | 4/320 |
| 4,131,959 | 1/1979 | Albertassi et al. | 4/320 X |
| 4,246,665 | 1/1981 | Albertassi et al. | 4/320 |
| 4,333,185 | 6/1982 | Heinze et al. | 4/319 |

FOREIGN PATENT DOCUMENTS

| | | | |
|---|---|---|---|
| 997559 | 7/1965 | United Kingdom | 4/319 |
| 1293083 | 10/1972 | United Kingdom | 4/319 |

*Primary Examiner*—Henry K. Artis

*Attorney, Agent, or Firm*—Robert T. Gammons

[57] ABSTRACT

In a toilet system wherein the bowl is evacuated by a pump, the intake side of which is connected by a first conductor to the bowl and the discharge side of which is connected by a second conductor to a waste pipe, a bypass conductor connecting the first conductor to the waste pipe and a valve at the junction operable when the pump is disabled to permit the bowl to be flushed through the bypass conductor.

7 Claims, 1 Drawing Figure

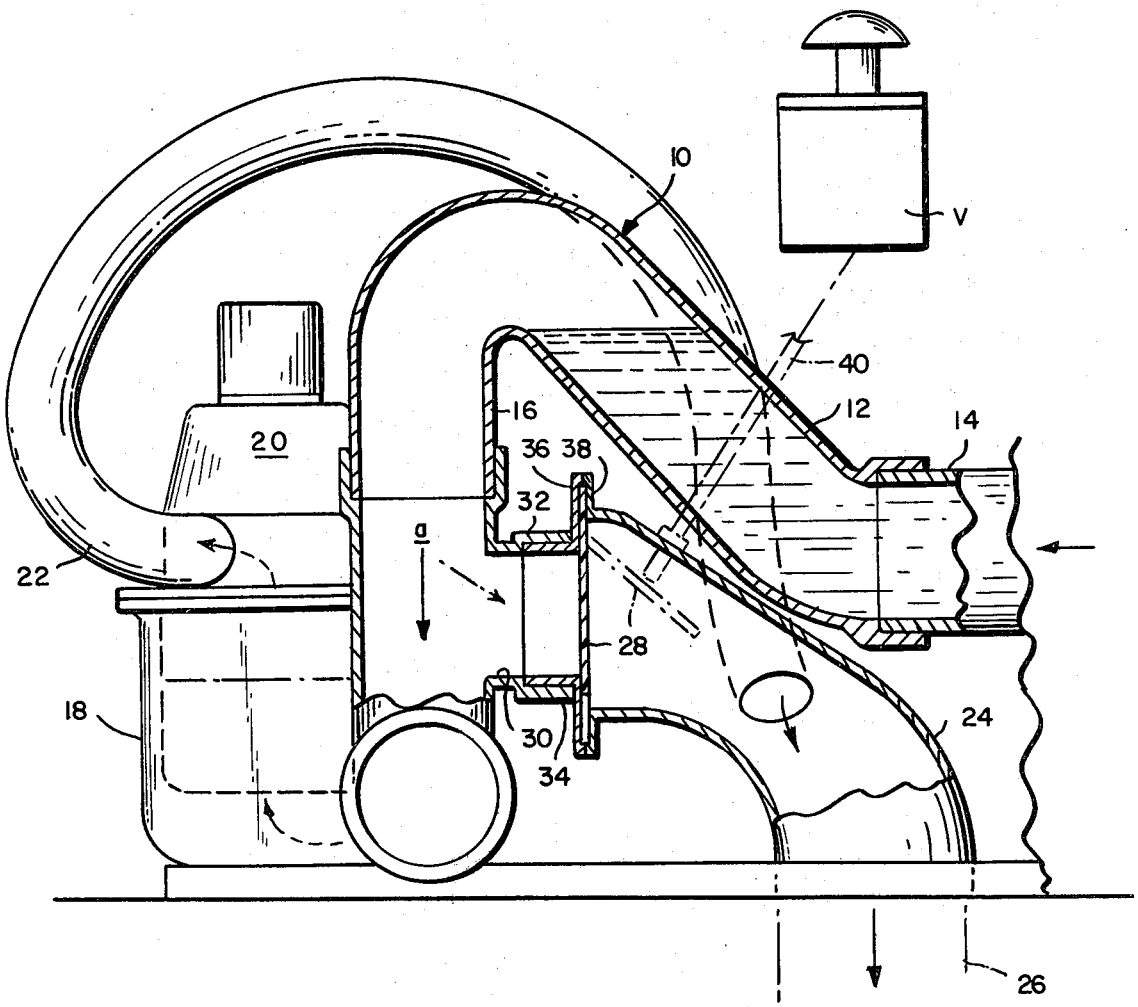
10
V
40
12
14
16
36 38
32
20
a
22
28
18
30
34
24
26

BYPASS VALVE FOR A TOILET SYSTEM

BACKGROUND OF INVENTION

Toilet systems wherein effluent is flushed from a toilet bowl into a treating tank for treatment and then discharged into a waste pipe are well-known as, for example, the system in U.S. Ser. No. 147,484, filed May 7, 1980. In such a system, if the pump by means of which discharge is effected becomes inoperative or there is a power failure, there is no way of flushing the system until the pump has been restored to operation and this may be extremely embarrassing if there is no other facility available. It is the purpose of this invention to provide for flushing the toilet bowl independently of the discharge pipe so that the toilet can be used effectively whenever necessary until the repairs of the pump or power supply can be completed.

SUMMARY OF INVENTION

A toilet system comprising a toilet bowl, treating tank and primary conductor connecting the bowl to the tank wherein a pump is connected to the treating tank for evacuating the treated effluent and discharging it into a waste pipe and a bypass conductor connects the primary conductor to the waste pipe and a valve member at the junction of the primary conductor and the bypass conductor is responsive to a positive pressure in the primary conductor to direct the effluent from the primary conductor into the bypass conductor and from thence into the soil pipe. The valve is held in the closed position by negative pressure created by the pump. Positive pressure to open the valve is provided by manually dumping flush water into the toilet bowl in sufficient amount to create a head in the primary conductor which will open the valve. Optionally, means is provided for supplying flush water to the toilet bowl in such quantity as to produce the aforesaid head and means for simultaneously mechanically opening the valve.

The invention will now be described in greater detail with reference to the accompanying drawing, wherein the single drawing shows the bypass system of this invention partly in elevation and partly in section.

Referring to the drawing, there is shown a trap 10 comprising an inclined portion 12 connected at its lower end to one end of a conductor 14, the other end of which is connected to the bottom of a toilet bowl not shown and a vertical portion 16 connected at its lower end to a treating tank 18 within which effluent flushed from the bowl is to be treated before discharge. A pump 20 supported at the top of the treating tank provides for evacuating the treating tank and discharging the treated effluent through a conductor 22, one end of which is connected to the discharge side of the pump 20 and the other end of which is connected by way of a bypass conductor 24 to a soil pipe 26.

In a system of this kind, if the pump 20 becomes inoperative for mechanical reasons or because of power failure, effluent cannot be flushed from the toilet bowl until the repair is made and this can be quite embarrassing if there is no other facility available. It is the purpose of this invention to rectify this situation so that the toilet can continue to be used as often as needed until the repairs can be consummated. This is achieved herein by providing the bypass conductor 24 referred to above, one end of which is connected to the waste pipe 26 and the other end of which is connected to the vertical portion 16 of the trap 10 by way of a flapper valve 28. To accomplish this, the vertical portion 16 of the trap is provided with flanged openings 30,32 within which there is positioned a coupling 34 provided with a radial flange 36. The valve 28 which is comprised of a flexible material is clamped to the flange 36 by means of an opposing flange 38 at the end of the bypass conductor 24.

As thus constructed, in the normal operation position when the toilet is flushed, the pump 20 operates to evacuate the treating chamber 18, thus to induce flow from the toilet bowl. The flow of effluent is vertically downward as indicated by the arrow a and this downward flow produces a negative pressure at the left-hand side of the valve member 28 which, together with its own elasticity which tends to maintain it in a vertical position, maintains the bypass conductor 24 closed so that the effluent flows into the treating tank 18 for treatment before it is discharged. If, however, the pump 20 becomes inoperative or there is a power failure and flow cannot be maintained through the pump, the system can be used by dumping water into the toilet bowl in sufficient volume so that it produces a head of fluid in the vertical position 16 of the trap sufficiently high to create a positive pressure which will displace the valve 28 and discharge then will take place directly through the bypass 24 to the soil pipe.

Optionally, a secondary supply of flush water may be provided controlled by a flooding valve "V." The flooding valve "V" is linked to or coupled to a push rod 40 which manually holds the flapper valve 28 closed until a head of water is observed in the bowl, whereupon the valve is quickly closed and the push rod is withdrawn so as to release the flapper valve to empty the trap and bowl of its contents.

The apparatus as described provides a very simple expedient for maintaining effective operation of a toilet system in spite of failure and while it is illustrated and used in conjunction with the system shown in the aforesaid application for patent, it is within the scope of the invention to employ it in conjunction with any toilet system within which it can be incorporated for the purpose intended.

It should be understood that the present disclosure is for the purpose of illustration only and includes all modifications or improvements which fall within the scope of the appended claims.

What is claimed is:

1. In a toilet system comprising a toilet bowl, a treating tank, a primary conductor connecting the bowl to the tank, a pump connected to the treating tank for evacuating the treated effluent and discharging it into a waste pipe, a bypass conductor connecting the primary conductor to the waste pipe and a valve member at the junction of the primary conductor and the bypass conductor responsive to a positive pressure in the primary conductor to direct the effluent from the primary conductor into the bypass conductor.

2. A toilet system according to claim 1 wherein the valve is held in the closed position by negative pressure in the primary conductor.

3. A toilet system according to claim 1 wherein the valve member is flexible and is held in its closed position by its resistance to displacement.

4. A toilet system according to claim 1 wherein the valve is elastically resistant to deflection and is held in its undeflected position partly by its inherent elasticity and partly by negative pressure.

5. A toilet system according to claim 1 comprising means which can be moved to a position to hold the flapper valve closed and means for supplying flush water to the toilet bowl and trap, said second means being operative to release the flapper valve following filling the trap with flush water.

6. A toilet system according to claim 5 wherein the second means is a valve and the first means is a rod coupled to the valve.

7. In a toilet system, a bowl, a pump, a first conductor connected at one end to the bowl and at the other end to the inlet side of the pump, a waste pipe, a second conductor connected at one end to the discharge side of the pump and at the other end to the waste pipe, a bypass conductor connected at one end to the first conductor between the bowl and the pump and at its other end to the waste pipe and a valve at the junction of the bypass with the first conductor operable when the pump is disabled to permit the bowl to be flushed through the bypass conductor.

* * * * *